US012704125B1

(12) United States Patent
Shelander

(10) Patent No.: US 12,704,125 B1
(45) Date of Patent: Aug. 11, 2026

(54) IN-SITU SERVICEABLE GEAR PUMP

(71) Applicant: Ace Machine Design Inc., Commerce, CA (US)

(72) Inventor: Agustus Shelander, Joshua Tree, CA (US)

(73) Assignee: Ace Machine Design Inc., Commerce, CA (US)

( * ) Notice: Subject to any disclaimer, the term of this patent is extended or adjusted under 35 U.S.C. 154(b) by 0 days.

(21) Appl. No.: 18/988,214

(22) Filed: Dec. 19, 2024

Related U.S. Application Data

(60) Provisional application No. 63/612,091, filed on Dec. 19, 2023.

(51) Int. Cl.
*F04C 2/10* (2006.01)
*F04C 15/00* (2006.01)

(52) U.S. Cl.
CPC ..... *F04C 2/101* (2013.01); *F04C 15/00* (2013.01); *F04C 15/0023* (2013.01); *F04C 2230/60* (2013.01); *F04C 2230/70* (2013.01); *F04C 2230/85* (2013.01); *F04C 2240/50* (2013.01)

(58) Field of Classification Search
CPC ..... F04C 2/101; F04C 15/00; F04C 2230/60; F04C 2230/70; F04C 2230/85; F04C 15/0023; F04C 2240/50
See application file for complete search history.

(56) References Cited

U.S. PATENT DOCUMENTS 1,768,818 A * 7/1930 Bock ..... F04C 2/101 418/170
1,793,577 A * 2/1931 Wilsey ..... F04C 2/101 277/345
1,896,033 A 1/1933 Sperry
2,983,228 A * 5/1961 Wagner ..... F04C 2/101 418/169

FOREIGN PATENT DOCUMENTS

EP 2078860 B1 7/2009

OTHER PUBLICATIONS

Chinese Patent Publication and Machine translation for CN 104329250 A; 1st Inventor: Fu; Title: A Pulsating Bidirectional Gear Pump With Low Flow Rate; Published: Feb. 4, 2015. (Year: 2015).*
Japanese Patent Publication and Machine translation for JP 4785295 B2; Title: Right Angle Shaft Type Pump; Published: Oct. 5, 2011. (Year: 2011).*

* cited by examiner

*Primary Examiner* — Mary A Davis
(74) *Attorney, Agent, or Firm* — Canady & Lortz LLP; Bradley K. Lortz

(57) ABSTRACT

The present invention exhibits a set of improvements that increases the serviceability of the known internal gear pump employing a key and matching keyway engagement between the drive shaft and a star gear. A primary benefit is that all wetted components can be accessed by only removing the front cover assembly and do not require the internal gear pump be disconnected from its drive motor or piping. Furthermore, the mechanical seals are designed to be serviced from the front of the pump such that all wetted surfaces can be accessed, cleaned, serviced by removing the front cover assembly, with the pump installed in place. Additionally, a bearing unit supporting the drive shaft is similarly removable from the front of the pump.

12 Claims, 9 Drawing Sheets

IN-SITU SERVICEABLE GEAR PUMP

CROSS-REFERENCE TO RELATED APPLICATIONS

This application claims the benefit under 35 U.S.C. § 119(e) of the following U.S. provisional patent application, which is incorporated by reference herein:

U.S. Provisional Patent Application No. 63/612,091, filed Dec. 19, 2023, and entitled "In-situe Serviceable Gear Pump," by Shelander.

FIELD OF THE INVENTION

The present invention relates generally to internal gear pumps. Particularly, the present invention relates to improved internal gear pumps making them easier to clean and service the internal components.

BACKGROUND

Prior art internal gear pumps are well known and employ a gear with external teeth rotating within another gear having internal teeth and often with a crescent-shaped divider to pump fluids. Fluid is forced in one direction by movement of the teeth of both the inner gear and outer gear as they pass the crescent-shaped divider when they are not engaged with one another. The space between the inner and outer gear teeth as they pass the crescent-shaped divider is filled with the driven fluid. In contrast, as the gears rotate to move in the opposite direction they are then engaged with one another which displaces any fluid and therefore inhibits forcing fluid in the reverse direction. Many internal gear pumps exist in the prior art.

U.S. Pat. No. 1,896,033, issued Jan. 31, 1933, discloses a pump case having a cylindrical chamber into which is threaded the cover housing. The cover provides a bearing for the rotor shaft which is provided with an enlarged concentric head. The bottom wall of the case presents a flat surface at right angles to the axis of the rotor shaft and over-which the rotor of the pump wipes or bears. The enlarged head of the rotor shaft mounts an internal toothed rotor which is secured in central fixed relation thereto. The teeth of this rotor engage a toothed idler pinion, which idler is rotatably mounted upon a stud secured to the case in eccentric relation to the toothed rotor. The space between the outer circumference of the teeth of the pinion and the inner circumference of the rotor is filled with a crescent shaped extension extending upward from the flat surface of the case.

European Patent No. EP2078860, issue Sep. 30, 2015, discloses an internal gear pump, having an internal gear and a gearwheel which mesh with one another, and the gearwheel is received about an axis on a drive shaft which runs at an eccentricity with respect to the axis of the internal gear, and are received in a housing, characterized in that the housing is configured in two pieces and comprises a pump housing which is mounted without play in a support housing.

In view of the foregoing, there is need in the art for internal gear pumps that are inexpensive to manufacture and readily serviceable. Particularly, there is a need for such internal gear pumps that can be serviced in situ without removing the installed pump. These and other needs are met by the embodiments of the invention described herein.

SUMMARY OF THE INVENTION

The present invention exhibits a set of improvements that increases the serviceability of the known internal gear pump employing a key and matching keyway engagement between the drive shaft and a star gear. A primary benefit is that all wetted components can be accessed by only removing the front cover assembly and do not require the internal gear pump be disconnected from its drive motor or piping. Furthermore, the mechanical seals are designed to be serviced from the front of the pump such that all wetted surfaces can be accessed, cleaned, serviced by removing the front cover assembly, with the pump installed in place. Additionally, a bearing unit supporting the drive shaft is similarly removable from the front of the pump.

A typical embodiment of the invention comprises an internal gear pump having a pump housing having a cavity open to a front side and a back wall with a hole therethrough, a drive shaft passed through the hole, a star gear having star gear teeth, the star gear coupled to the drive shaft, a ring gear having ring gear teeth circumferentially around an open center, the star gear disposed within the open center and a portion of the ring gear teeth are engaged with a portion of the star gear teeth, a crescent shaped divider affixed to the back wall of the pump housing and disposed within the open center between another portion of the ring gear teeth and another portion of the star gear teeth, and a front cover assembly enclosing the cavity of the pump housing from the front side. The drive shaft is coupled to the star gear by a radial key and keyway capable of sliding axially between the drive shaft and the star gear such that the star gear is removable from the drive shaft to the front side when the front cover assembly is removed. Alternately, the drive shaft and the star gear can be coupled together as a single unit. The ring gear can be removable to the front side when the front cover assembly is removed after the star gear is removed. The front cover assembly can be secured to the pump housing with a plurality of screws (which can have knurled heads for hand assembly and disassembly). The front cover assembly can comprise a window for viewing the cavity with the front cover assembly enclosing the cavity in operation.

Further embodiments of the invention can include a bearing unit disposed in an annular space around the hole for the drive shaft, the bearing unit capable of sliding axially such that the bearing unit is removable from the drive shaft to the front side when the front cover assembly is removed after the star gear is removed. The bearing unit can be removable to the front side when the front cover assembly is removed after the star gear is removed. A compression spring can be disposed in the annular space behind the bearing unit forces the bearing unit against a rear surface of the star gear and compresses a rear sealing mechanism between the bearing unit and the rear surface of the star gear. The rear sealing mechanism can comprise an o-ring within a circular groove of the bearing unit.

Similarly, a typical method embodiment of the invention comprises the steps of providing a pump housing having a cavity open to a front side and a back wall with a hole therethrough, providing a drive shaft passed through the hole, providing a star gear having star gear teeth, the star gear coupled to the drive shaft, providing a ring gear having ring gear teeth circumferentially around an open center, the star gear disposed within the open center and a portion of the ring gear teeth are engaged with a portion of the star gear teeth, providing a crescent shaped divider affixed to the back wall of the pump housing and disposed within the open center between another portion of the ring gear teeth and another portion of the star gear teeth, and providing a front cover assembly enclosing the cavity of the pump housing from the front side. The drive shaft is coupled to the star gear by a radial key and keyway capable of sliding axially between the drive shaft and the star gear such that the star gear is removable from the drive shaft to the front side when the front cover assembly is removed. The method embodiment of the invention can be modified consistent with any apparatus embodiment described herein.

BRIEF DESCRIPTION OF THE DRAWINGS

Referring now to the drawings in which like reference numbers represent corresponding parts throughout:

FIGS. 7A to 7C are right perspective views of gear elements of the internal gear pump, wherein FIG. 7A shows the ring gear alone, FIG. 7B shows the star gear alone, and FIG. 7C shows the ring gear and the star gear together (i.e., engaged);

DETAILED DESCRIPTION OF THE INVENTION

1. Overview

Embodiments of the present invention can comprise an internal gear pump having a pump housing, input shaft, sealing element, star gear, ring gear and front plate. The pump housing has an inlet port, outlet port, a bore for the shaft to pass through a cavity for a sealing element and a set of cavities for the star and ring gears to rotate such that if driven by the input shaft the meshing and un-meshing of the gears will convey fluid from the inlet port to the outlet port.

Embodiments of the present invention afford a set of improvements that increase the serviceability of the common internal gear pump. The primary feature of these embodiments is that all wetted components can be accessed by simply removing the front plate. Therefore, there is no requirement for the pump be disconnected from its drive motor or piping and removed from installation for service. Furthermore, the mechanical seal for the pump is also designed to be serviced form the front of the pump such that all wetted surfaces can be accessed, cleaned, and serviced by removing the front plate, with the pump installed in place, i.e. in situ.

2. Exemplary Internal Gear Pump

Figure 1:
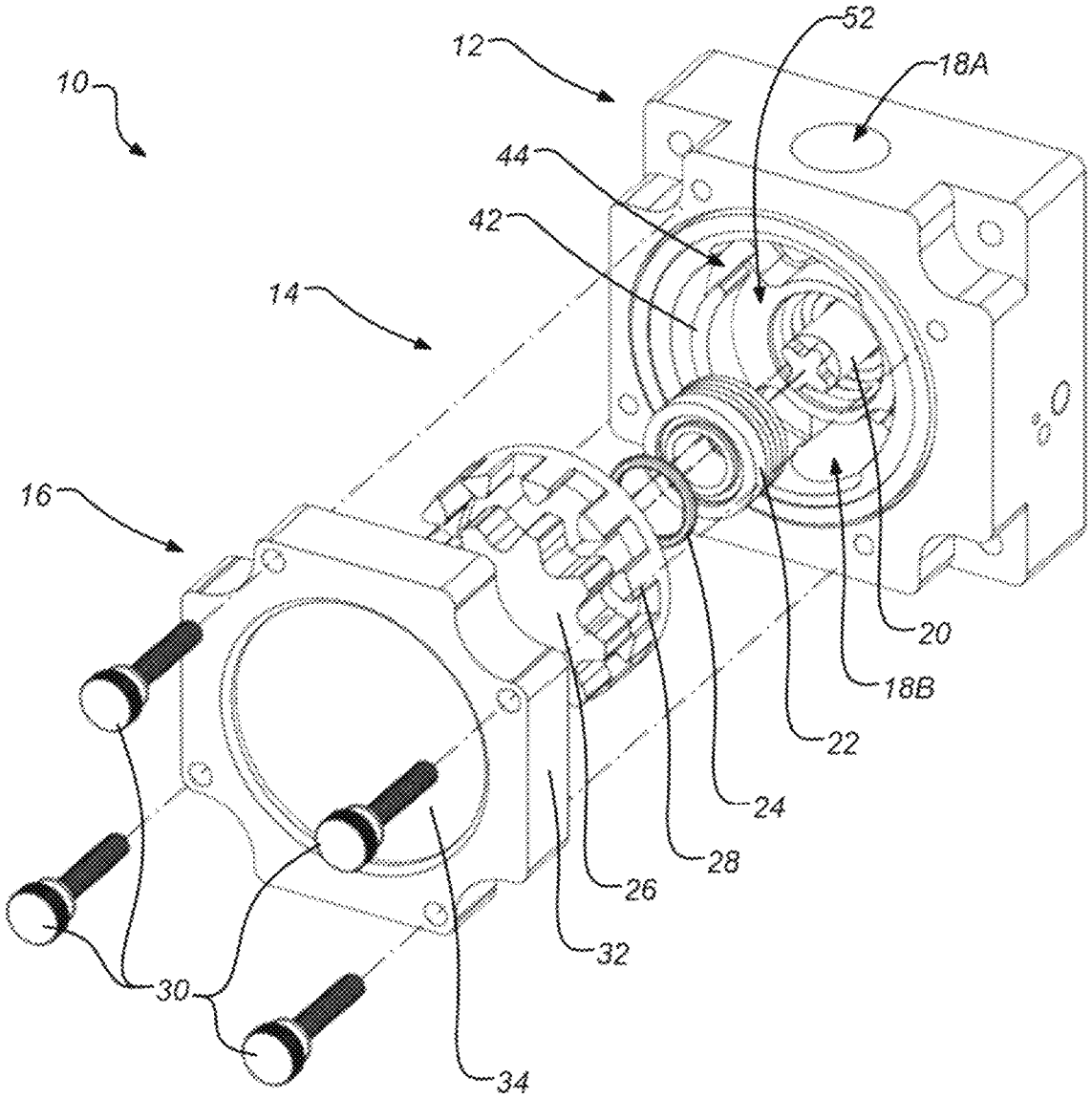
FIG. 1 is an exploded view of an internal gear pump in accord with the present invention.

As illustrated in the various drawings herein, and particularly in the view of FIG. 1, internal gear pump embodiments of the invention are depicted by the general reference character 10. FIG. 1 is an exploded view of an internal gear pump 10 in accord with the present invention. The internal gear pump 10 includes a pump housing 12, internal components 14, and a front cover assembly 16.

The pump housing 12 is straightforward, having a cavity 44 housing the internal components 14 which force the fluid through the pump 10. The pump housing 13 mates with the front cover assembly 16 to enclose the cavity 44. The pump housing 12 includes two ports 18A, 18B on opposing sides of the pump housing 12 which access the pump cavity, an inlet port 18A for passing fluid into and an outlet port 18B for passing the fluid out of the internal gear pump 10. When the drive shaft 20 is driven counterclockwise as viewed from the front, the top port 18A is the inlet for receiving fluid and the bottom port 18B is the outlet for fluid. However, if instead the drive shaft 20 is driven in the clockwise direction, the bottom port 18B will be the inlet and the top port 18A will be the outlet. Note also, that the orientation of the ports 18A, 18B can be varied; the ports 18A, 18B can be disposed on the left and right sides or any other opposing directions to suit the particular application and installation site.

The internal components 14 include a drive shaft 20, a bearing unit 22 for supporting the shaft 20, a rear sealing mechanism 24, a star gear 26, and a ring gear 28. The drive shaft 20 passes through a bore in the rear of the pump housing 12 into the housing cavity, through the bearing unit 22 and the rear sealing mechanism 24 and engages with the star gear 26 disposed within the cavity.

The bearing unit 22 rotatably supports the drive shaft 20 and can employ conventional bearings. For example, bearing unit 22 can be a single roller type bearing or it can be multiple ball type bearings depending upon the pump design requirements for flow rate, pressure, and working fluid viscosity as will be understood by those skilled in the art.

The rear sealing mechanism 24 seals the back of the internal gear pump 10, preventing fluid from leaking past the bearing unit 22 and the drive shaft 20, and out the back of the internal gear pump 10. The rear sealing mechanism 24 can alternately be simple and entirely conventional, e.g. an O-ring within a groove on the drive shaft 20, as will be understood by those skilled in the art.

Forcing fluid through the pump is facilitated by the driven star gear 26 and ring gear 28. The ring gear 28 is an 'idling' type gear which is rotatably driven by the star gear 26. The ring gear 28 engages with the star gear 26, which in turn is rotatably driven via the drive shaft 20 as discussed above.

Importantly, within the cavity 44 of the pump housing 12 affixed to the back wall of the cavity 44 is a crescent shaped divider 42 which maintains disengagement of the teeth of the star gear 26 and the ring gear 28 as they rotate past this area. Accordingly, the spaces between the teeth of both the star gear 26 and the ring gear 28 carry fluid which is thereby forced from the upper inlet port to the lower outlet port under counterclockwise rotation of the drive shaft 20. As the teeth of the rotating gears 26, 28 rotate around from lower port to the upper port their teeth engage which blocks any significant fluid from being carried in reverse as the spaces between the teeth of the gears 26, 28 are now filled under movement in this direction. Making the crescent shaped divider 42 affixed (or integral) with the pump housing 12 at a back wall 52 allows for the pump 10 to be serviced by removing the front cover assembly 16 while the pump 10 remains in situ, i.e. with the pump housing 12 mounted in place and the plumbing to the inlet and outlet ports 18 connected. In one efficient example, the crescent shaped divider 42 can be machined into the pump housing 12 as an integral part. Alternately, the crescent shaped divider 42 could be bolted, bonded or simply designed to be trapped within a keyed space within the housing 12 with the front cover assembly 16 secured to hold it in place.

The front cover assembly 16 encloses and seals the cavity 44 within the pump housing 12 of the internal gear pump 10, preventing fluid from leaking out the front of the internal gear pump 10. The front cover assembly 16 includes multiple screws 30 extending through a front plate 32, wherein the edge plate 32 mates with the pump housing 12 and is held there against by the screws 30 threaded into the pump housing 12. Further, the front cover assembly 16 shown in FIG. 1 includes an optional window 34, permitting viewing into the internal gear pump 10 during operation, and a front sealing mechanism 36 (e.g., an O-ring, not visible in FIG. 1) to assist in preventing fluid from leaking out the front of the internal gear pump 10. The window 34 can be made from plexiglass or any other suitable transparent material (selected to be compatible with the working fluid for the pump) and properly sealed into the front plate 32 as will be understood by those skilled in the art.

The pump 10 can be driven by any suitable means appropriately sized for the particular fluid and flow rate as will be understood by those skilled in the art. An external drive system (e.g., a conventional electric, gas or any other suitable motor) rotatably drives the drive shaft 20 such that the meshing and enmeshing of the gears 26, 28 conveys fluid from one port 18A (the inlet port) to the other port 18B (the outlet port) as previously described.

Figure 2:
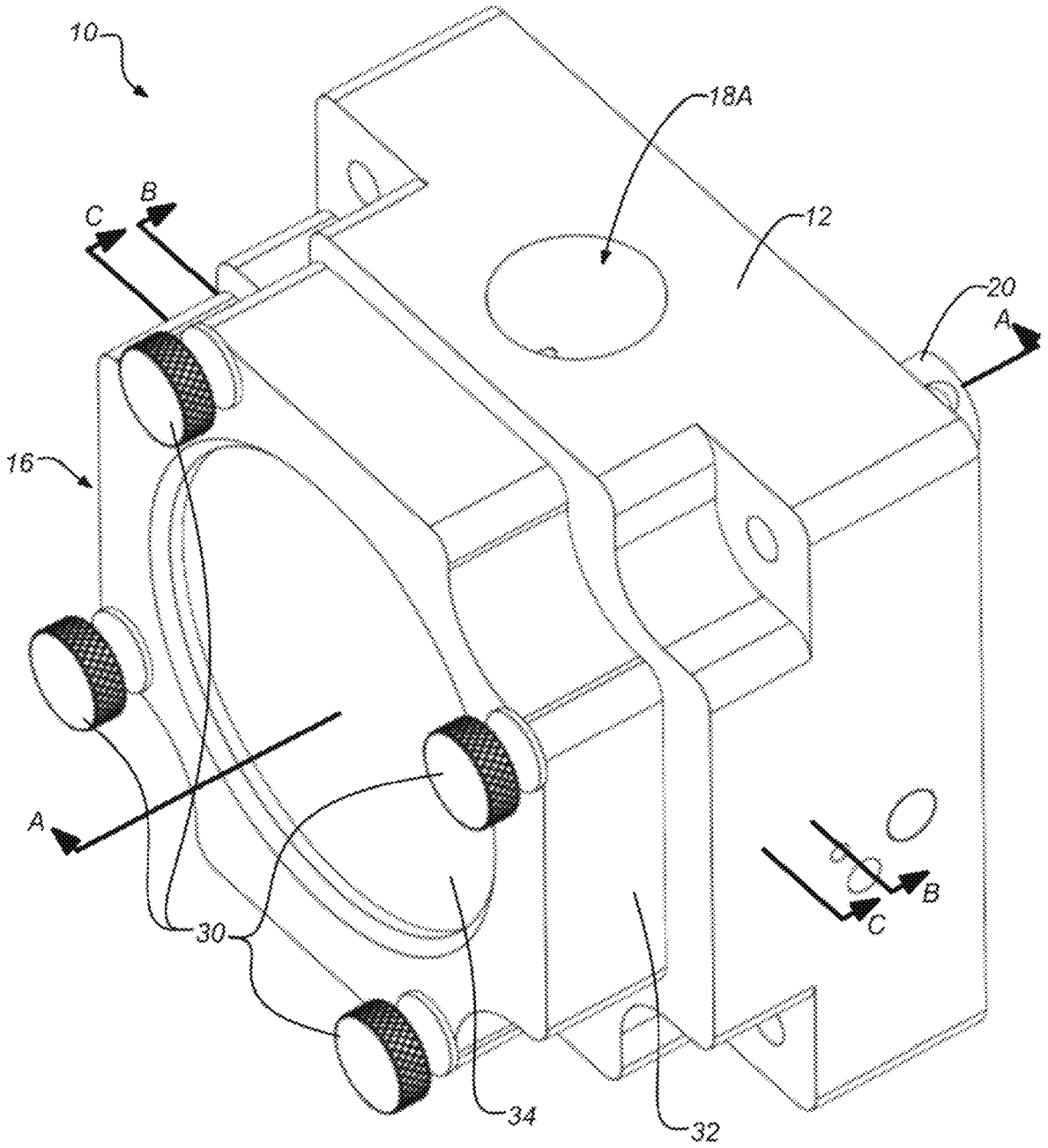
FIG. 2 is a right-side perspective view of the internal gear pump.

FIG. 2 is a perspective view of the internal gear pump 10. The pump housing 12 and various of its elements (upper port 18A and the drive shaft 20) are shown here. Also visible is the front cover assembly 16 including screws 30, front plate 32, and window 34. Although any suitable number and size of screws 30 can be employed, it can be desirable to employ screws 30 with knurled heads so that they can be fully installed and removed by hand without requiring a tool. This aids in the serviceability of the pump 10.

Figure 3:
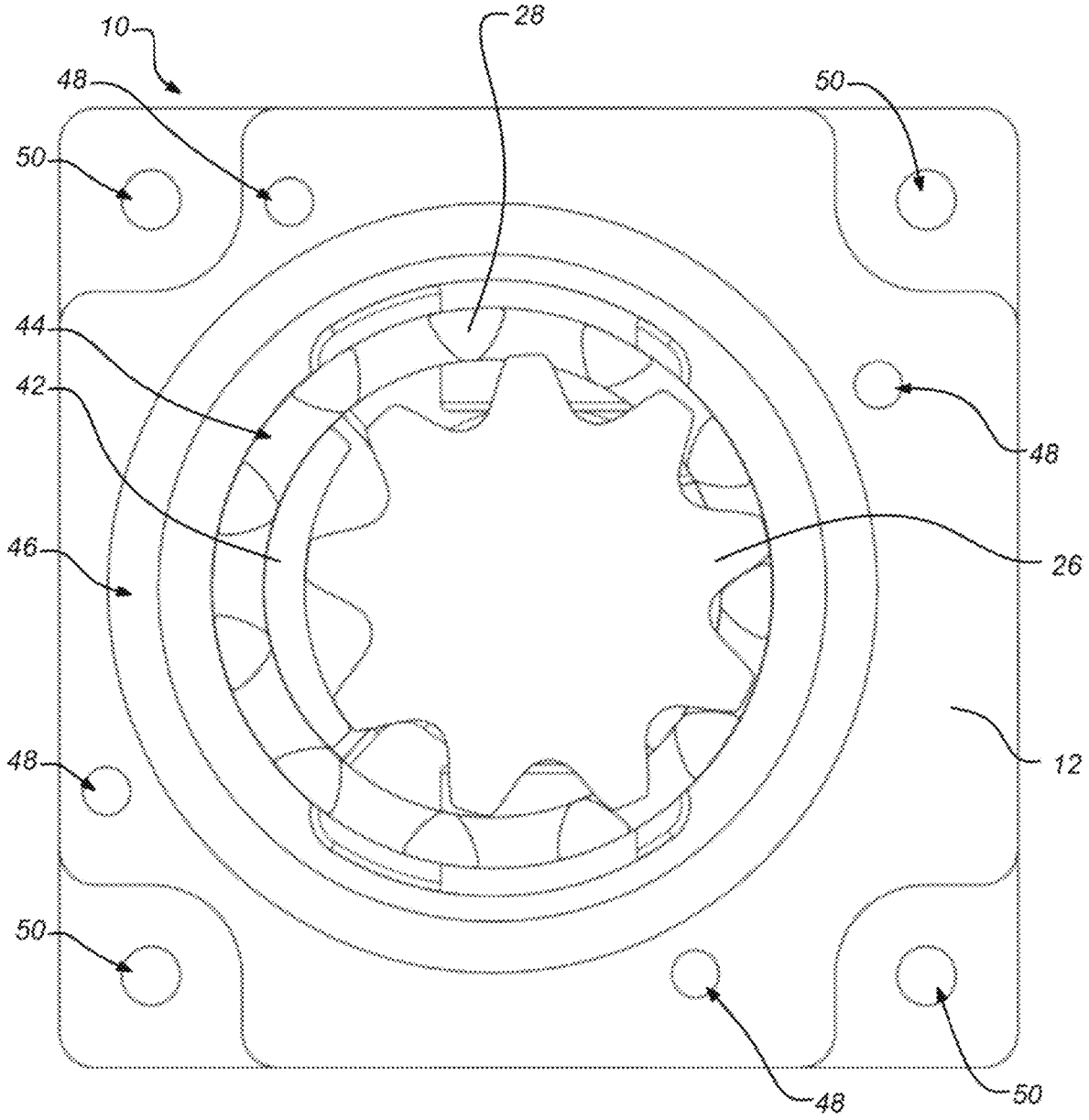
FIG. 3 is a front view of the internal gear pump, wherein the front cover assembly is removed to show internal features.

FIG. 3 is a front view of the internal gear pump with the front plate 32 removed to show internal features. Here the star gear 26, the ring gear 28, and the crescent shaped divider 42 and the meshing and enmeshing of the gear teeth principal of operation are visible within the cavity 44 of pump housing 12. Also shown is a circular seal groove 46 cut around the opening to the cavity 44 for supporting a front sealing mechanism 36 as described hereafter as well as threaded holes 48 for receiving the bolts 30 to secure the front plate 32 to the pump housing 12. The additional holes 50 in the pump housing 12 can be used to secure the pump 10 in an installation location with bolts and any other suitable fasteners. As previously discussed, installation of the pump 10 need not be disturbed in order to service the internals.

Figure 4:
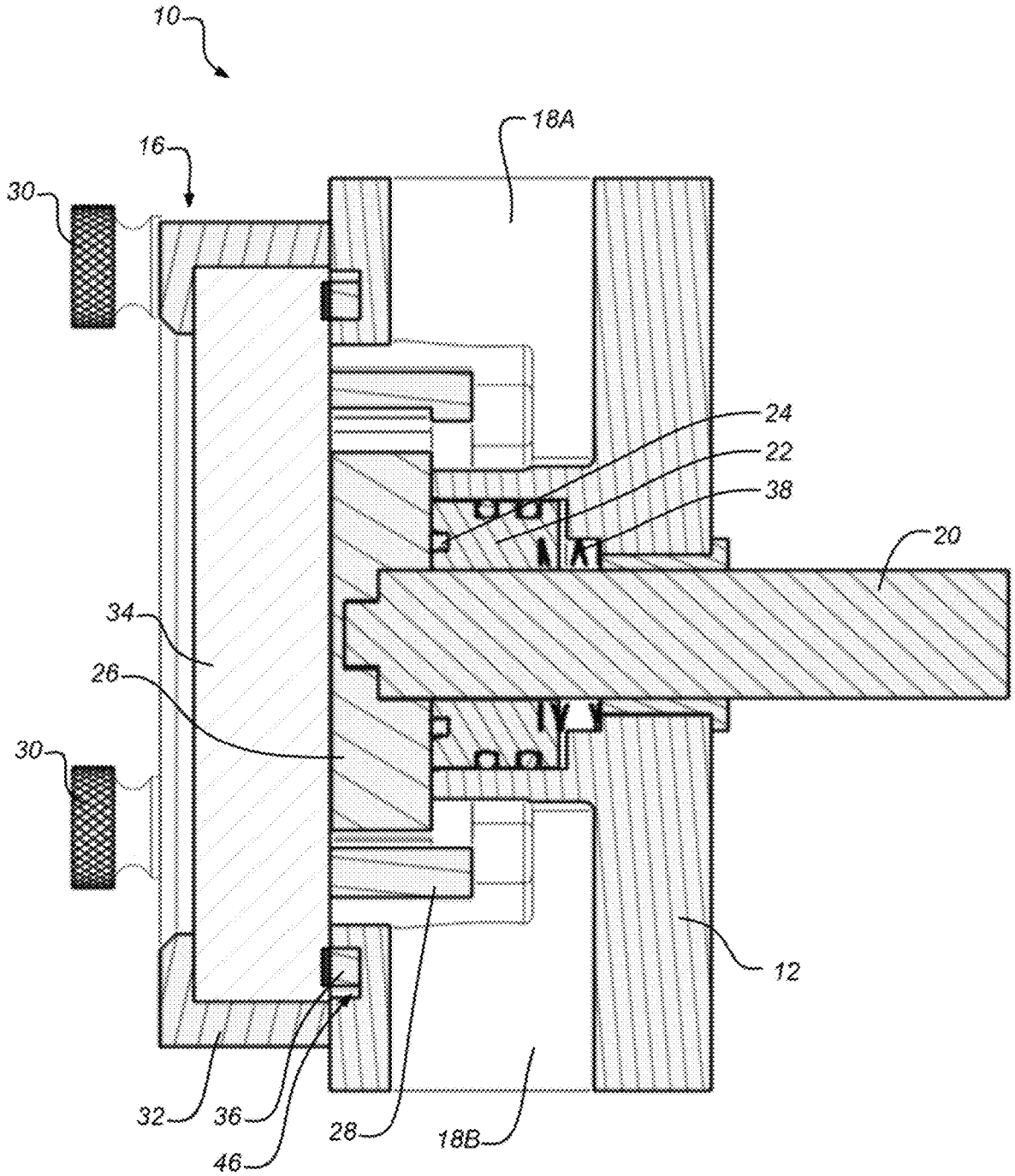
FIG. 4 is a right-side cross-sectional view of the internal gear pump.

FIG. 4 is a right-side cross-sectional view of the internal gear pump 10, taken along section A-A indicated in FIG. 2. Most elements shown here have been described above. Two exceptions are a front sealing mechanism 36 of the front cover assembly 16 and a compression spring 38 that forces the rear sealing mechanism 24 against a rear surface of the star gear 26. The front sealing mechanism 36 can be an o-ring which fits in the circular seal groove 46 and is compressed against the front cover assembly 16, which is specifically a surface of the window 34 in the shown example. If a window is not used, the front plate 32 will instead fill the space of the window 34 shown. The spring 38 of the rear sealing mechanism 24 assists in the rear sealing mechanism 24 in performing its sealing function by maintaining contact between the rear sealing mechanism and the rear of the star gear 26. Additionally, this permits front based disassembly of the internal components 14 from the internal gear pump 10 after simple removal of the front cover assembly 16.

Figure 5:
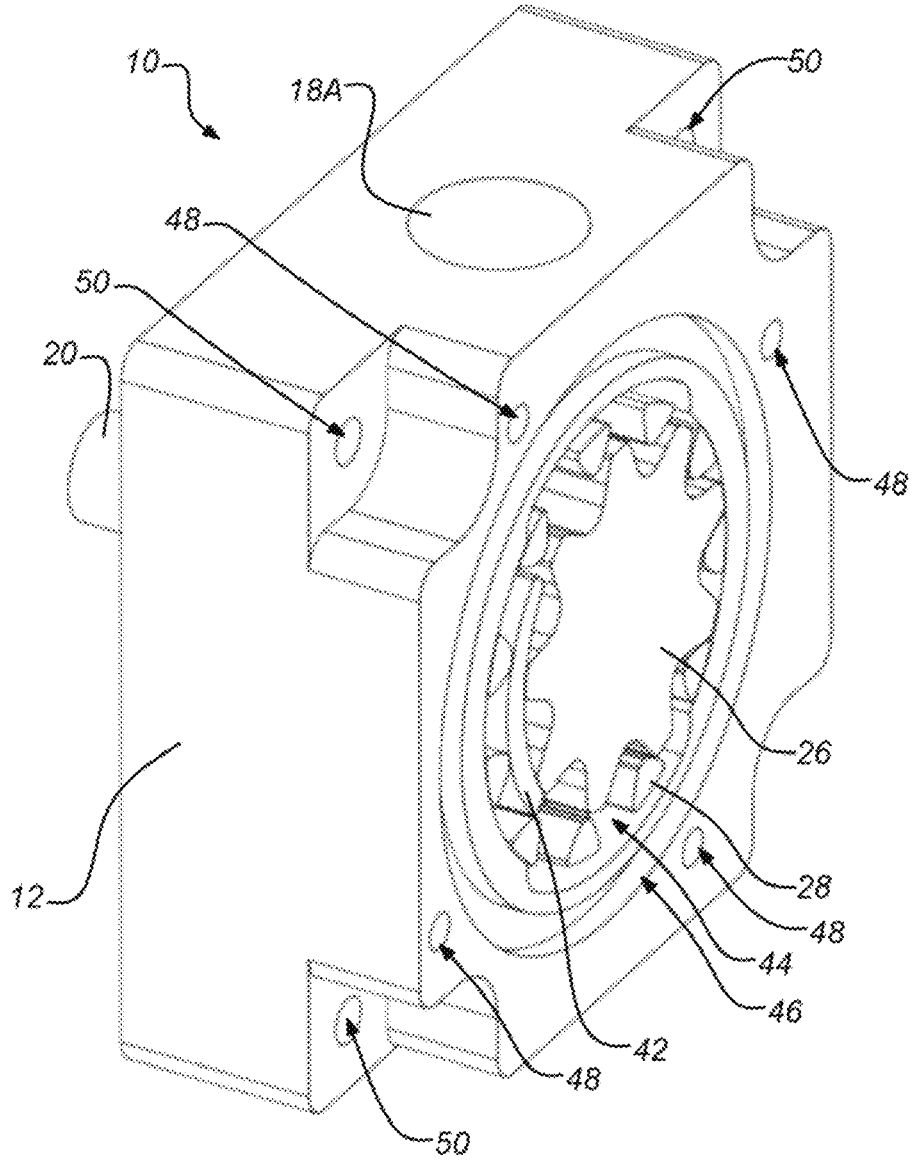
FIG. 5 is left-side perspective view of the internal gear pump, wherein the front cover assembly is again removed to show internal features.
Figure 6:
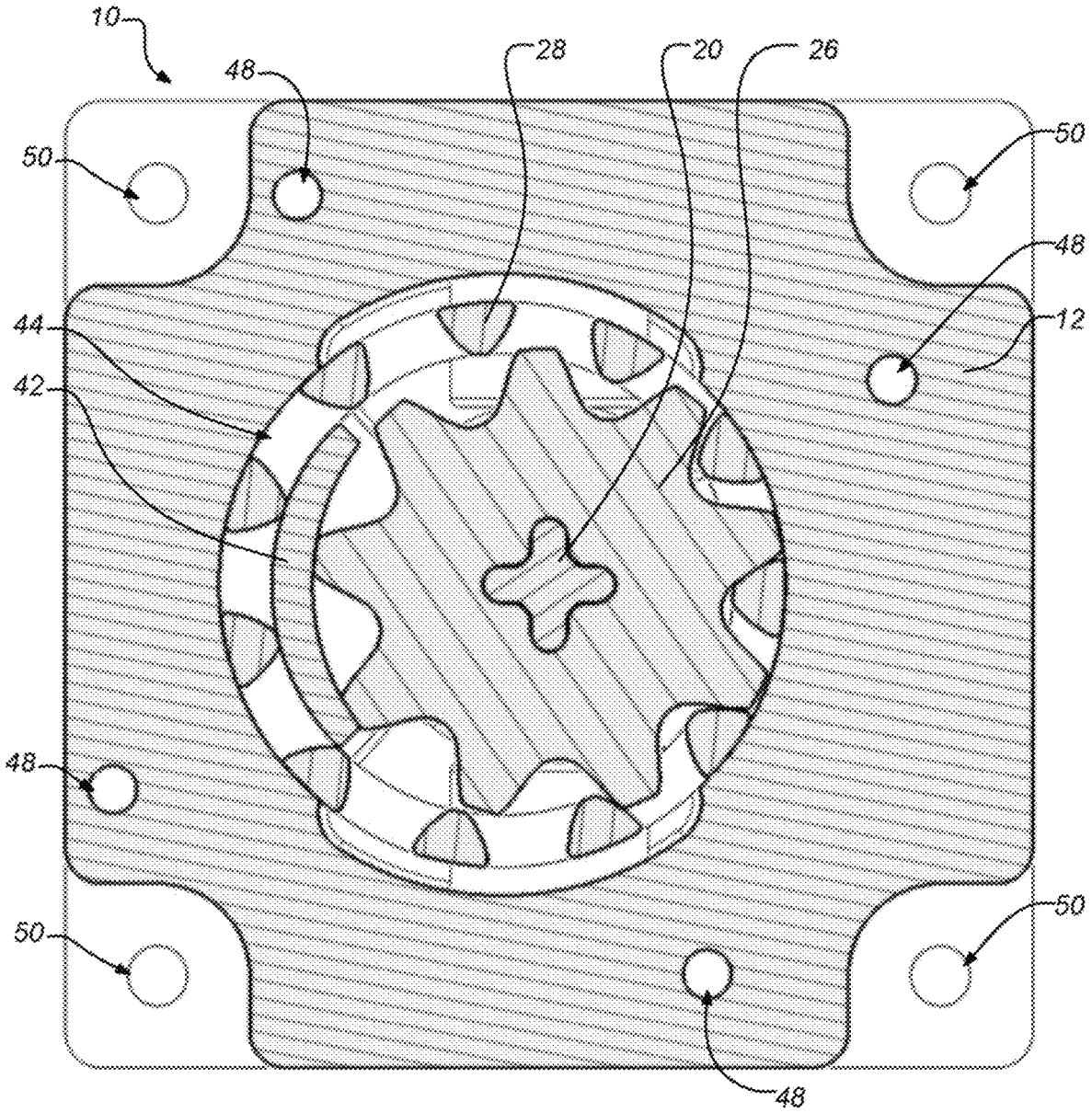
FIG. 6 is a front-side cross section view of the internal gear pump.

FIG. 5 is left-side perspective view of the internal gear pump 10, wherein the front cover assembly 16 is again removed to show internal features and FIG. 6 is a front-side cross section view of the internal gear pump 10, taken along section B-B indicated in FIG. 2. In order to enable serviceability of the pump 10 from the open front side, engagement between the drive shaft 20 and the star gear 26 can be implemented with a radial key and matching keyway that slides axially between the drive shaft 20 and the star gear 26. As shown, engagement between the drive shaft 20 and the star gear 26 is made with a cross shaped key on the end of the drive shaft 20 that engages a matching cross shaped keyway on the back of the star gear 26. Note that although the embodiment is shown with the key machined onto the shaft 20 and the keyway on the gear 26, the keyway could be on the shaft 20 and the key on the gear 26 instead. It is only necessary that the two engage through sliding along the shaft 20 axis and support the required driven power to operate the pump 10. Further, those skilled in the art will appreciate that any suitable known means of engaging a radial key and keyway between a shaft and driven member may be employed, e.g. spline. The engagement between the drive shaft 20 and star gear 26 is seen clearly in FIG. 4.

It should also be noted that the pump 10 can still retain serviceability of the pump 10 from the open front side even if the drive shaft 20 and star gear 26 are implemented as a single unit, i.e. where the drive shaft 20 is integral to the star gear 26 and therefore eliminating the radial key and matching keyway engagement between them. However, in this case, the drive shaft 20 will engage a motor behind the housing 12. The engagement between the drive shaft 20 and motor behind the housing 12 can be through a radial key and matching keyway (or any other suitable coupling, e.g. a spline) as described above between the shaft 20 and star gear 26. However, it is necessary that any coupling features on the shaft 20 must have a smaller diameter than the through hole for the shaft 20 into the housing 12 in order for the shaft 20 to be capable of being pulled into the housing 12 to the front side along with the star gear 26.

Figure 7A:
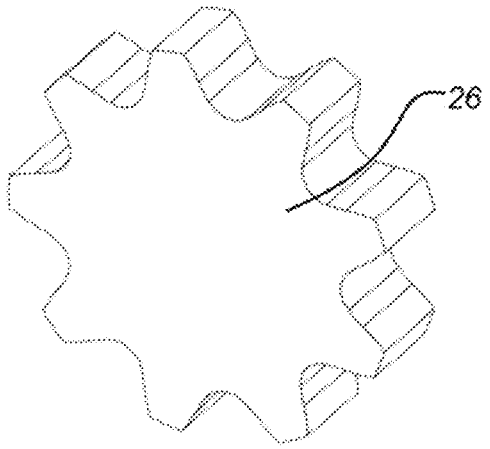
Figure 7B:
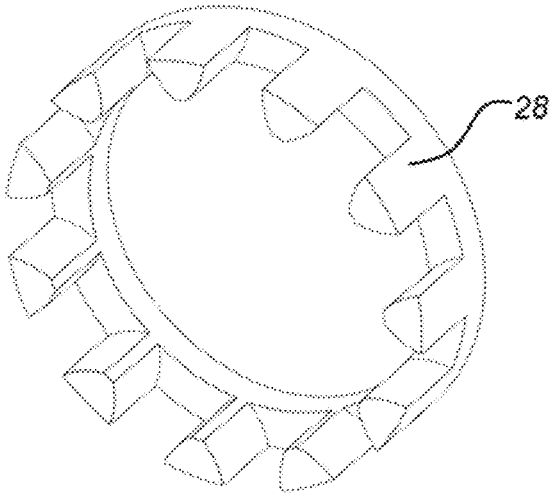
Figure 7C:
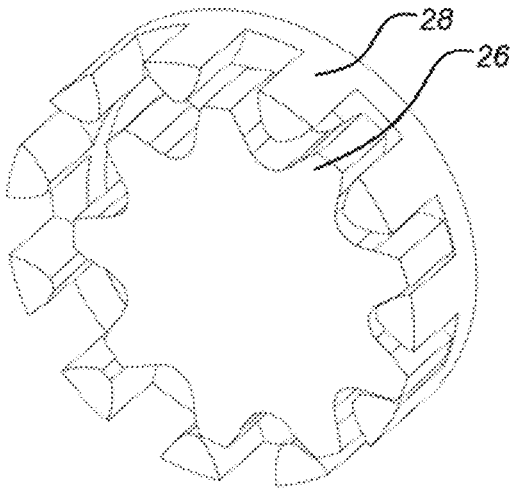

FIGS. 7A-7C are right perspective views of the gear elements of the internal gear pump 10, wherein FIG. 7A shows the star gear 26 alone, FIG. 7B shows the ring gear 28 alone, and FIG. 7C shows the star gear 26 and the ring gear 28 with their teeth engaged as they are when installed in the pump 10. The crescent shaped divider 42 is not shown on the opposite side where the teeth are disengaged because this element is affixed within the pump housing 12 as previously described.

Figure 8:
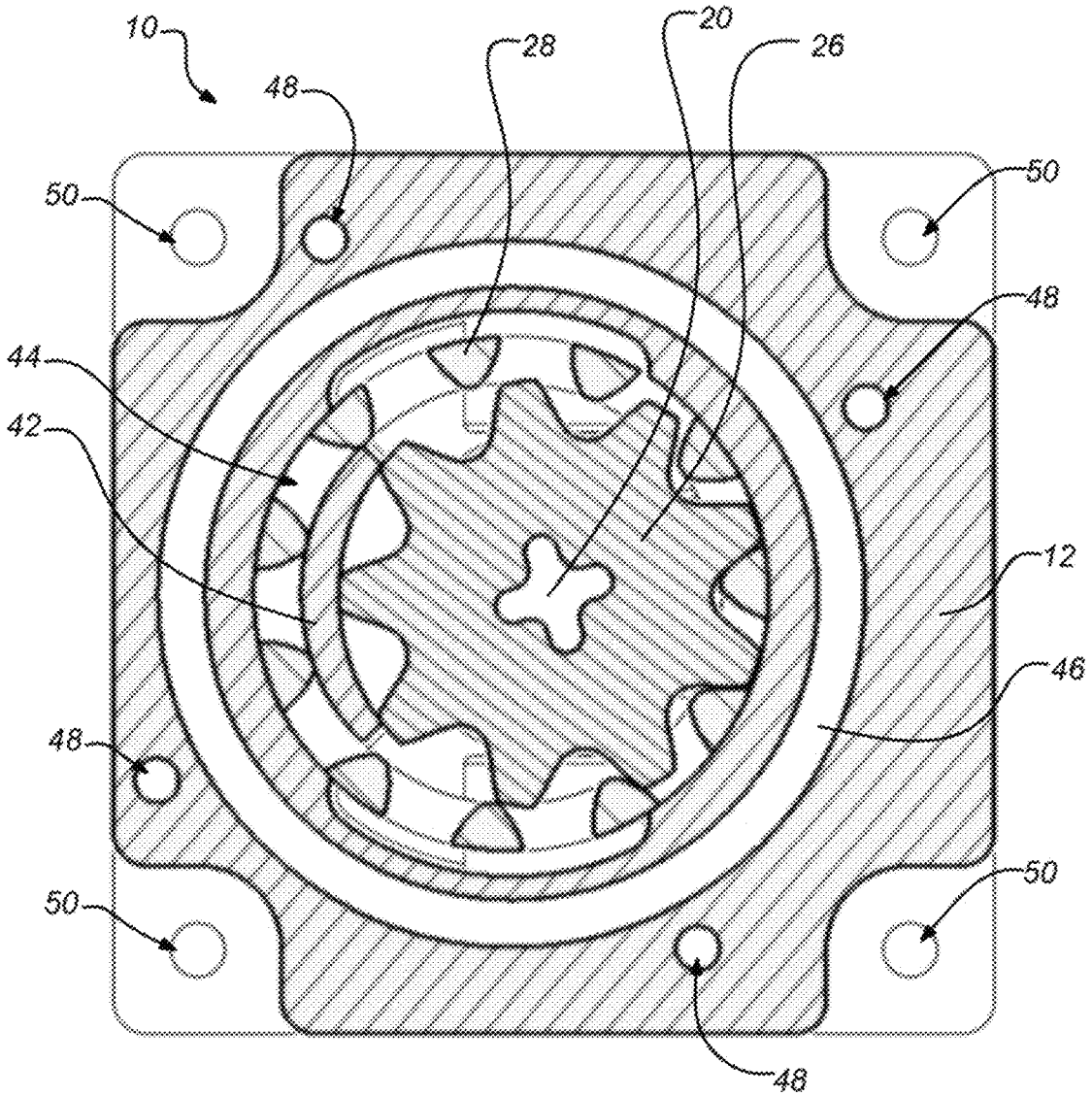
FIG. 8 is an alternate front-side cross section view of the internal gear pump.

FIG. 8 is an alternate front-side cross section view of the internal gear pump 10, taken along section C-C in FIG. 2 (shallower cut from the front surface than the B-B section). A key feature here is seal groove 46 in the pump housing 12, to hold the front sealing mechanism 36 of the front cover assembly 16 (e.g., an O-ring) as previously described.

4. Method of Producing an In Situ Serviceable Internal Gear Pump

Typically, all elements of an exemplary embodiment of the in situ serviceable internal gear pump can be manufactured from any suitable metal, e.g. aluminum or steel. In one example the housing, star gear, ring gear, drive shaft, bearing unit, and front cover assembly can be conventionally produced as machined aluminum or steel parts and then assembled using appropriately sized off the shelf components, e.g. screws, axles and bushings or bearings. However, embodiments of the invention can also be produced from known plastics, phenolics, composites or any other suitable non-metal material depending upon the application. Furthermore, embodiments of the invention can also be produced using a suitable combination of metal and non-metal components as will be appreciated by those skilled in the art.

Figure 9:
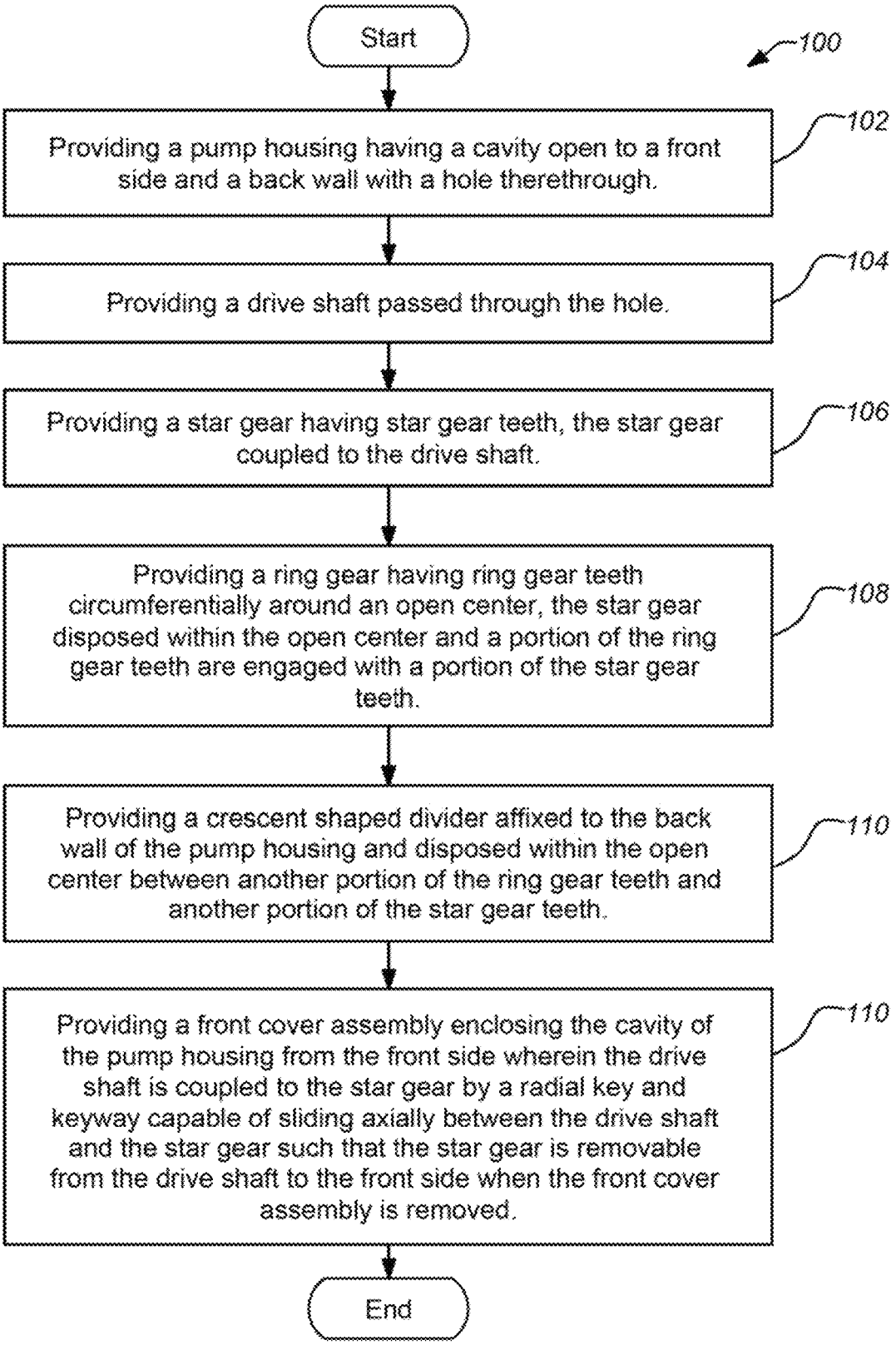
FIG. 9 is a flow chart of an exemplary method embodiment of producing an internal gear pump.

FIG. 9 is a flowchart showing an exemplary method for producing a sliding vane rotary pump embodiment of the invention. The method 100 for making an internal gear pump comprising the steps of providing a pump housing having a cavity open to a front side and a back wall with a hole therethrough 102, providing a drive shaft passed through the hole 104, providing a star gear having star gear teeth, the star gear coupled to the drive shaft 106, providing a ring gear having ring gear teeth circumferentially around an open center, the star gear disposed within the open center and a portion of the ring gear teeth are engaged with a portion of the star gear teeth 108, providing a crescent shaped divider affixed to the back wall of the pump housing and disposed within the open center between another portion of the ring gear teeth and another portion of the star gear teeth 110, and providing a front cover assembly enclosing the cavity of the pump housing from the front side wherein the drive shaft is coupled to the star gear by a radial key and keyway capable of sliding axially between the drive shaft and the star gear such that the star gear is removable from the drive shaft to the front side when the front cover assembly is removed 112. This method 100 can be further modified consistent with any of the apparatus embodiments of the invention described herein.

While various embodiments have been described above, it should be understood that they have been presented by way of example only, and that the breadth and scope of the invention should not be limited by any of the above described exemplary embodiments but should instead be defined only in accordance with the following claims and their equivalents.

This concludes the description including the preferred embodiments of the present invention. The foregoing description including the preferred embodiment of the invention has been presented for the purposes of illustration and description. It is not intended to be exhaustive or to limit the invention to the precise forms disclosed. Many modifications and variations are possible within the scope of the foregoing teachings. Additional variations of the present invention may be devised without departing from the inventive concept as set forth in the following claims.

What is claimed is:

1. An internal gear pump comprising:

a pump housing having a cavity open to a front side and a back wall with a hole therethrough;

a drive shaft passed through the hole;

a star gear having star gear teeth, the star gear coupled to the drive shaft;

a ring gear having ring gear teeth circumferentially around an open center, the star gear disposed within the open center and a portion of the ring gear teeth are engaged with a portion of the star gear teeth;

a crescent shaped divider affixed to the back wall of the pump housing and disposed within the open center between another portion of the ring gear teeth and another portion of the star gear teeth;

a front cover assembly enclosing the cavity of the pump housing from the front side;

a bearing unit disposed in an annular space around the hole for the drive shaft, the bearing unit capable of sliding axially such that the bearing unit is removable from the drive shaft to the front side when the front cover assembly is removed after the star gear is removed; and a compression spring disposed in the annular space behind the bearing unit forces the bearing unit against a rear surface of the star gear and compresses a rear sealing mechanism between the bearing unit and the rear surface of the star gear;

wherein the drive shaft is coupled to the star gear by a radial key and keyway capable of sliding axially between the drive shaft and the star gear such that the star gear is removable from the drive shaft to the front side when the front cover assembly is removed.

2. The internal gear pump of claim 1, wherein the ring gear is removable to the front side when the front cover assembly is removed after the star gear is removed.

3. The internal gear pump of claim 1, wherein the rear sealing mechanism comprises an o-ring within a circular groove of the bearing unit.

4. The internal gear pump of claim 1, wherein the front cover assembly is secured to the pump housing with a plurality of screws.

5. The internal gear pump of claim 1, wherein the front cover assembly comprises a window for viewing the cavity with the front cover assembly enclosing the cavity in operation.

6. The internal gear pump of claim 1, wherein the drive shaft and the star gear are coupled together as a single unit.

7. A method of making an internal gear pump comprising the steps of:

providing a pump housing having a cavity open to a front side and a back wall with a hole therethrough;

providing a drive shaft passed through the hole;

providing a star gear having star gear teeth, the star gear coupled to the drive shaft;

providing a ring gear having ring gear teeth circumferentially around an open center, the star gear disposed within the open center and a portion of the ring gear teeth are engaged with a portion of the star gear teeth;

providing a crescent shaped divider affixed to the back wall of the pump housing and disposed within the open center between another portion of the ring gear teeth and another portion of the star gear teeth;

providing a front cover assembly enclosing the cavity of the pump housing from the front side; and a bearing unit disposed in an annular space around the hole for the drive shaft, the bearing unit capable of sliding axially such that the bearing unit is removable from the drive shaft to the front side when the front cover assembly is removed after the star gear is removed;

wherein the drive shaft is coupled to the star gear by a radial key and keyway capable of sliding axially between the drive shaft and the star gear such that the star gear is removable from the drive shaft to the front side when the front cover assembly is removed; and wherein a compression spring disposed in the annular space behind the bearing unit forces the bearing unit against a rear surface of the star gear and compresses a rear sealing mechanism between the bearing unit and the rear surface of the star gear.

8. The method of claim 7, wherein the ring gear is removable to the front side when the front cover assembly is removed after the star gear is removed.

9. The method of claim 7, wherein the rear sealing mechanism comprises an o-ring within a circular groove of the bearing unit.

10. The method of claim 7, wherein the front cover assembly is secured to the pump housing with a plurality of screws.

11. The method of claim 7, wherein the front cover assembly comprises a window for viewing the cavity with the front cover assembly enclosing the cavity in operation.

12. The method of claim 7, wherein the drive shaft and the star gear are coupled together as a single unit.

* * * * *